US009010578B2

(12) United States Patent
Keller

(10) Patent No.: US 9,010,578 B2
(45) Date of Patent: Apr. 21, 2015

(54) DISCHARGE ARRANGEMENT HAVING A CONNECTING DEVICE BETWEEN A MULTI-COMPONENT CARTRIDGE AND AN ACCESSORY PART

(75) Inventor: Wilhelm A. Keller, Merlischachen (CH)

(73) Assignee: Medix Systems AG, Rotkreuz (CH)

( * ) Notice: Subject to any disclaimer, the term of this patent is extended or adjusted under 35 U.S.C. 154(b) by 107 days.

(21) Appl. No.: 13/500,363

(22) PCT Filed: Jun. 29, 2010

(86) PCT No.: PCT/CH2010/000166

§ 371 (c)(1),
(2), (4) Date: Apr. 5, 2012

(87) PCT Pub. No.: WO2011/041917

PCT Pub. Date: Apr. 14, 2011

(65) Prior Publication Data

US 2012/0199607 A1 Aug. 9, 2012

(30) Foreign Application Priority Data

Oct. 6, 2009 (EP) ..... 09405177

(51) Int. Cl.

| | |
|---|---|
| ***B67D 7/70*** | (2010.01) |
| ***B05C 17/005*** | (2006.01) |
| ***B01F 5/06*** | (2006.01) |

(52) U.S. Cl.

CPC ..... *B05C 17/00553* (2013.01); *B01F 5/0615* (2013.01); *B05C 17/00503* (2013.01); *B05C 17/00509* (2013.01)

(58) Field of Classification Search

CPC ..... B05C 17/0566; B05C 17/00553; B05C 17/00503; B05C 17/00509; B05C 17/00566; B05C 17/00533; B01F 5/0615

USPC ..... 222/137, 134, 145, 5, 6, 145.5, 145.6; 220/293, 297–301; 433/82

See application file for complete search history.

(56) References Cited

U.S. PATENT DOCUMENTS

| | | | | |
|---|---|---|---|---|
| 4,538,920 | A * | 9/1985 | Drake | 366/181.5 |
| 5,033,650 | A | 7/1991 | Colin et al. | |

(Continued)

FOREIGN PATENT DOCUMENTS

| | | | | |
|---|---|---|---|---|
| DE | 89 00 469 | U1 | 1/1989 | |
| EP | 0 284 352 | A2 | 3/1988 | |
| EP | 0 730 913 | A1 | 11/1995 | |
| EP | 0 730 913 | A1 | 9/1996 | |
| EP | 1 440 737 | A1 | 1/2003 | |
| EP | 1 440 737 | A1 | 7/2004 | |
| EP | 1566211 | B1 | 9/2006 | |
| WO | 2005/021394 | A1 | 10/2005 | |
| WO | 2006/095179 | A1 | 9/2006 | |
| WO | WO 2007/098624 | A1 * | 9/2007 | 22/145.6 |
| WO | 2008/113196 | A1 | 9/2008 | |

OTHER PUBLICATIONS

European Office Action pursuant to rule 71(3) EPC and third-party observation under rule 114(2) EPC corresponding to European Patent Application No. 10727335.1, dated May 6, 2013.

International Search Report for PCT/CH2010/000166 dated Aug. 4, 2010.

Notice of Opposition for corresponding European Patent Application No. 2 485 852, issued Jul. 29, 2014.

*Primary Examiner* — Lien Ngo

(74) *Attorney, Agent, or Firm* — Sughrue Mion, PLLC

(57) ABSTRACT

The invention relates to a discharge arrangement, comprising a two-component cartridge (2) and an accessory part, for example, a mixer (3). A connecting component (11, 12) of a connecting device is arranged on each of the two parts. In order to make it easier and simpler to attach the accessory part to and remove the accessory part from the cartridge, one connecting component (11, 12) comprises an insertion receptacle (20, 21) and the other connecting component (12, 11) comprises a connection part (5) that can be inserted therein in the longitudinal direction, wherein mutually corresponding engagement parts (6, 7, 25, 26) of a rotational guide placed at an incline in the longitudinal direction are provided on the inner circumference in the insertion receptacle (20, 21) and on the outer circumference on the connection part (5), along which rotational guide the connecting components (11, 12) can be rotated in one another over an effective connecting section after being inserted into one another and thus can be brought increasingly in or out of engagement with each other.

17 Claims, 4 Drawing Sheets

(56) References Cited

U.S. PATENT DOCUMENTS

| | | | | |
|---|---|---|---|---|
| 5,080,262 | A | 1/1992 | Herold et al. | |
| 5,413,253 | A * | 5/1995 | Simmen | 222/137 |
| 5,466,020 | A | 11/1995 | Page et al. | |
| 6,135,631 | A * | 10/2000 | Keller | 366/339 |
| 6,394,314 | B1 * | 5/2002 | Sawhney et al. | 222/137 |
| 6,398,761 | B1 * | 6/2002 | Bills et al. | 604/191 |
| 6,820,766 | B2 * | 11/2004 | Keller et al. | 222/137 |
| 7,694,853 | B2 | 4/2010 | Keller | |
| 7,874,458 | B2 * | 1/2011 | Sogaro | 222/137 |
| 8,074,843 | B2 * | 12/2011 | Keller | 222/137 |
| 8,376,187 | B2 * | 2/2013 | Keller | 222/137 |
| 8,746,509 | B2 * | 6/2014 | An | 222/145.6 |
| 2011/0151402 | A1 * | 6/2011 | An | 433/82 |

* cited by examiner

DISCHARGE ARRANGEMENT HAVING A CONNECTING DEVICE BETWEEN A MULTI-COMPONENT CARTRIDGE AND AN ACCESSORY PART

CROSS REFERENCE TO RELATED APPLICATIONS

This application is a National Stage of International Application No. PCT/CH2010/000166 filed Jun. 29, 2010, claiming priority based on European Patent Application No. 09 405 177.8 filed Oct. 6, 2009, the contents of all of which are incorporated herein by reference in their entirety.

TECHNICAL FIELD

The present invention relates to a discharge arrangement comprising a cartridge or syringe for at least two components and comprising an accessory part, with one connecting component of a connecting device being arranged on the syringe or cartridge and another on the accessory part.

PRIOR ART

U.S. Pat. No. 5,033,650 A1 discloses a discharge arrangement having a connecting device with bayonet closure parts, wherein the bayonet claws are beveled in order to guide the tongue-like projections of the bayonet closure part axially on the accessory part and tighten the latter. However, the axial guiding is effective only during the tightening, not during the untightening.

EP 1 440 737 A1 discloses a discharge arrangement comprising a two-component cartridge and a mixer or other accessory part, which have means complementing each other in order to join them together in a given orientation and secure them to each other. Fitting the mixer onto the cartridge in a predefined orientation meets the purpose of providing a uniquely reproducible and therefore particularly reliable connection. Said document proposes the provision of means of orientation in the form of individual outlets with different diameters on the cartridge and of corresponding inlets on the mixer. Moreover, a thread is arranged on the cartridge, as a result of which the mixer can be secured on the cartridge by means of a union nut, so as to ensure a reliable sealing of the mixer with respect to the cartridge. Furthermore, two coding ridges are provided on the mixer and are adapted in shape to associated coding indents on the cartridge, so as to avoid undesired fitting of an unrelated accessory part. In addition to the mixer, a further accessory part is provided in the form of a closure cap with adapted stoppers, which closure cap can be secured on the cartridge by means of the same union nut and can be easily lifted off and removed from the cartridge by means of a pull-off disk.

WO 2008/113196 likewise discloses a discharge device comprising a two-component cartridge and an accessory part, e.g. a mixer. The accessory part has two inlets, which can be plugged into corresponding outlets of the cartridge. For this purpose, the accessory part is plugged axially onto the cartridge without a rotation movement. The housing of the accessory part forms a latch connection with the cartridge. To release the latch connection, the housing of the accessory part is turned relative to the cartridge. To make it easier to lift the accessory part from the cartridge, lifting means in the form of ramps are formed on the cartridge.

EP 0 730 913 also discloses a discharge device comprising a two-component cartridge and an accessory part, e.g. a mixer. The accessory part is secured on the cartridge by a bayonet connection. For this purpose, in some embodiments, inclined surfaces are formed on the cartridge and on the accessory part and, during securing, generate an axial force in order to move the accessory part and the cartridge toward each other. By contrast, during release of the connection between the accessory part and the cartridge, there is no axial force acting in the opposite direction, so as to facilitate removal.

SUMMARY OF THE INVENTION

While maintaining the advantages mentioned, it is still desirable to make some improvements to a discharge arrangement of this kind in order to further increase its user friendliness. Proceeding from this prior art, a first object is to produce a reliable and rapid connection between the cartridge and the accessory part in such a way that, with little force being applied, the accessory part can be secured sealingly on the cartridge and can also be lifted from the cartridge.

A discharge arrangement is thus specified, comprising:

an accessory part with at least two inlets;

a cartridge for at least two components, wherein the cartridge has at least two chambers for in each case one of the components and has at least two outlets, complementary to the inlets, for the components, wherein one of the outlets can be plugged respectively into one of the inlets, or vice versa; and a connecting device with a first connecting component, which is arranged on the accessory part, and a second connecting component, which is complementary to the first connecting component and is arranged on the cartridge, wherein one of the connecting components has a socket and the other connecting component has a connector part that can be inserted therein in the longitudinal direction.

To make it easier to secure and remove the accessory part, first engagement parts of a rotational guide placed at an incline to the longitudinal direction are provided on the outer circumference of the connector part, and corresponding second engagement parts of the rotational guide are provided on the inner circumference of the socket, along which rotational guide the connecting components, after the connector part has been plugged into the socket, can be rotated into each other over an effective connecting section and, being guided in the axial direction, can be brought increasingly into engagement with each other, and, over an effective connecting section and being guided in the axial direction, can be disengaged from each other. These engagement parts are designed in such a way that, when the connection is established, the accessory part is positively guided towards the cartridge, and such that, when the connection is released, the accessory part is lifted from the cartridge in a positively guided manner.

In a preferred embodiment, the first engagement parts extend over only a partial circumference of the connector part, and/or the second engagement parts extend over only a partial circumference of the socket, in particular at most a quarter of the circumference. The first and second engagement parts are preferably designed such that, during the securing of the accessory part, the connector part executes at most a quarter of a revolution before the first and second engagement parts abut against each other in the circumferential direction.

The first and second engagement parts can be respectively designed as an elevation on the outer wall of the connector part or as a depression in the inner wall of the socket.

The socket is preferably designed as at least two socket jaws, which are arranged spaced apart from each other and have a circularly curved inner wall. Guide grooves can be formed on the inner wall, which guide grooves form the second engagement parts and cooperate with the first engagement parts on the connector part.

Alternatively, the connector part can instead have at least two guide grooves, which are arranged on the outer circumference and form the first engagement parts. The socket is then once again designed as at least two socket jaws which are arranged spaced apart from each other and which in this case too can have a circularly curved inner wall. The second engagement parts are then formed on the inner wall of the socket.

Irrespective of whether the guide grooves are formed on the socket or on the connector part, each of the guide grooves is usually formed between a first edge, on the plug-in side with respect to the longitudinal direction, and a second edge extending substantially parallel thereto, i.e. the first and second edges delimit the respective guide groove with respect to the longitudinal direction. The second edge is then preferably longer in relation to the first edge, such that an axial plug abutment for a corresponding engagement part cooperating with the guide groove is formed.

The engagement parts cooperating with the guide grooves preferably comprise at least two ramps, which are designed corresponding to the guide grooves. In particular, the thickness of the ramps in the longitudinal direction preferably corresponds substantially to the width of the guide groove, i.e. to the distance between the edges that delimit the guide groove, and the inclination of the ramps corresponds to the inclination of the guide grooves.

The guide grooves and the engagement parts cooperating with them are preferably inclined with respect to the transverse direction to the longitudinal axis of the discharge arrangement at an angle of inclination of at least 4° and at most 20°, preferably of at least 7° and at most 16°.

If the socket forms socket jaws, gaps of different length are preferably formed between the socket jaws. The first engagement parts then preferably have different lengths corresponding to the different lengths of the gaps. In this way, a coding is obtained that prevents the accessory part from being applied in an undesired orientation.

Preferably, at least one of the engagement parts has a rotation abutment, so as to limit the range of rotation of the accessory part.

In preferred embodiments, the first connecting component, arranged on the accessory part, comprises the connector part, while the second connecting component, arranged on the cartridge, comprises the socket. In other words, the socket is in this case formed on the cartridge, and the connector part, which can be plugged into the socket, is arranged on the accessory part. However, a reverse arrangement is also possible in which the socket is arranged on the accessory part and in which the connector part to be plugged into the socket is arranged on the cartridge.

If the connector part is arranged on the accessory part, it is preferably rotatable with respect to the inlets of the accessory part, but axially secured. Particularly preferably, the connector part is substantially axially immovable relative to the inlets of the accessory part.

The connector part is in this case preferably designed as a union sleeve. In an alternative but less preferable embodiment, the connector part can be integrally formed directly on the housing of the accessory part. In the latter case, the housing is then rotatable with respect to the inlets of the accessory part and preferably axially immovable.

In order to ensure the uniquely oriented fitting of the accessory part onto the cartridge, the cartridge and the accessory part can have mutually complementary coding means. An example of such coding means has already been mentioned above. Further examples are set out below. Thus, the coding can be provided by a different width of at least one guide groove and/or ramp on the respective discharge arrangements. Alternatively or in addition, the coding can be provided by different diameters of the inlets and outlets. Alternatively or in addition, the coding can be provided by a coding lug on the accessory part and by a corresponding coding indent on the cartridge. Other types of coding are of course possible and are known from the prior art.

If the accessory part is a mixer, and cartridges with different volumes or mixing ratios are used, it is an object not to suppress the lesser component, in order thereby to achieve proportional mixing right at the start of the discharging procedure. For proportional mixing of two components, the mixer inlet area can then be provided with an end-plate and with a U-shaped deflecting web, in order to form a deflecting chamber together with the mixer housing, wherein the deflecting chamber has a separating web, which divides outflow openings connected to the outlets of the cartridge, and wherein the separating web is aligned with the separating edge of a first mixing coil.

By contrast, in the case of identical or similar mixing ratios, the mixer inlet area can be provided with an end-plate, in order to form a separating chamber together with the mixer housing, wherein the separating chamber has a separating web, which divides the outflow openings, and the separating web is aligned with the separating edge of the first mixing coil.

BRIEF DESCRIPTION OF THE DRAWINGS

The invention is explained in more detail below on the basis of preferred illustrative embodiments and with reference to the drawings, which reveal further characteristics and advantages of the invention. In the drawings.

DESCRIPTION OF PREFERRED EMBODIMENTS

Figure 1:
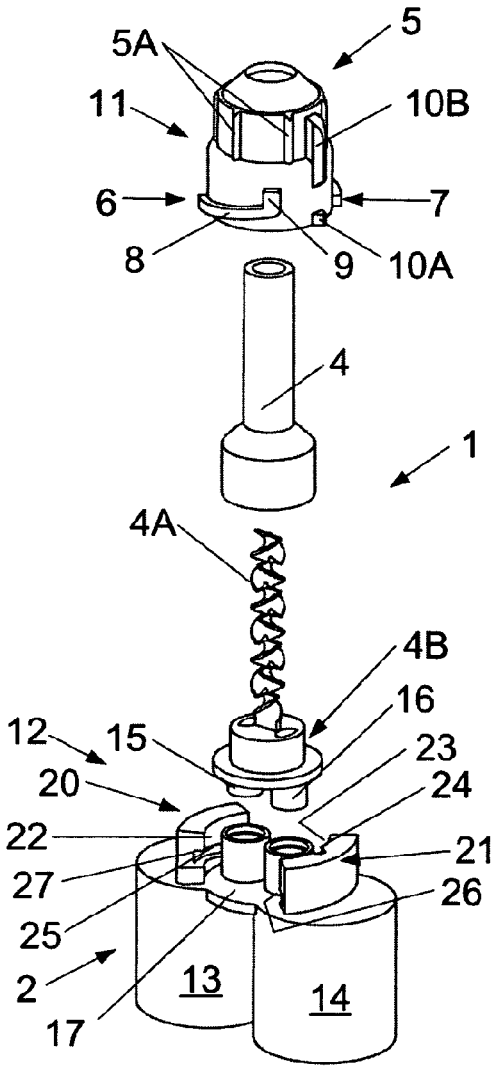
FIG. 1 shows an exploded view of a first embodiment of the invention.

FIG. 1 shows an exploded view of a first illustrative embodiment of a discharge arrangement 1 with a double cartridge 2 and an accessory part 3. In the following, the term "cartridge" means multi-component cartridges. The cartridge can be designed in particular as a double or multiple syringe, i.e. as a cartridge from which the components contained in it can be ejected by the advance of plungers. The accessory part 3 here is a mixer with a mixer tube 4, in which mixing elements 4A are arranged. Other accessory parts are conceivable too, for example closure stoppers or extension parts or the like. The mixing elements are secured, as is known per se, on a mixer input part 4B, which comprises the two inlets 15, 16, wherein the mixer tube is secured on the input part 4B and, together, they form the mixer 3. In the present case, the mixer 3 can be secured on the cartridge 2 by means of a connector part 5, which connector part is designed here as a union sleeve.

Two engagement webs 6, 7 are arranged on two mutually opposite jacket sections of the connector part 5 and are in each case composed of a ramp 8 and of a rotation abutment 9. The ramp 8 extends in each case along about a quarter of the outer circumference of the connector part 5 and has an incline in the direction of the longitudinal axis of the connector part 5. The incline is chosen such that the respective free end of the ramp is arranged nearer the inlet end of the connector part 5 than is the opposite end of the ramp. The connector part 5 and the engagement webs 6, 7 formed integrally thereon form a first connecting component 11 of the connecting device. Gripping ribs 5A are arranged on the outer circumference of the connector part 5.

It is in principle also possible, but not preferable, to form an identical connecting component 11 directly on the accessory housing, in which case the inner parts, for example mixing element or closure stopper, of the accessory are preferably rotatable with respect to the housing.

The cartridge 2 comprises two cylinder-shaped chambers 13, 14, each for one of the components. The jacket surfaces of the chambers 13, 14 are connected to each other along the longitudinal axis of the cartridge 2 (see FIG. 6). The second connecting component 12 of the connecting device, complementary to the first one, is arranged at the outlet-side end of the cartridge. Two outlets 18, 19 are located on the outlet flange 17 of the cartridge. The cartridge outlets are complementary to the mixer inlets, i.e. an outlet can be plugged into a respective inlet, or vice versa, wherein the diameters of the inlets of a mixer and therefore of the outlets of a cartridge do not have to be the same as each other and can, for example, have a ratio of 1:2 to 1:10. Moreover, the inlets and outlets, as is known per se, are made slightly conical, as a result of which a good seal is obtained. By this means, however, relatively high frictional or adhesive forces arise both during the tightening and also the untightening of the mixer, which forces have to be overcome by the connecting device.

The second connecting component 12 comprises two socket jaws 20, 21, which are arranged opposite each other and spaced apart from each other and which are arranged on the outlet flange 17 of the cartridge and in each case have a circularly curved inner wall 22, 23 corresponding to the cylinder shape of the connector part 5, such that in this way a socket is formed for the connector part 5. The gaps A and B between the two jaws in this case correspond to those circumferential sections A and B of the engagement webs 6 and 7 on the mixer (see FIGS. 2 and 3).

It is often important that the mixer or any other accessory part can be fitted and connected in a unique orientation. This requires complementary coding means both on the accessory part and also on the cartridge. One of these coding means is provided by different sectors for sections A and B or different diameters of the inlets/outlets.

Figure 2:
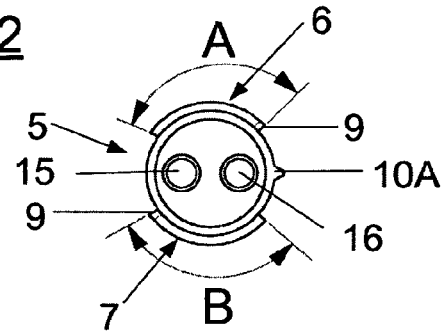
FIG. 2 shows a plan view of the inlet end of a mixer from FIG. 1.
Figure 3:
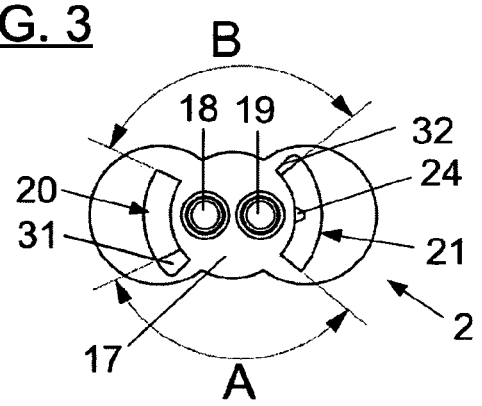
FIG. 3 shows a plan view of the outlet end of the cartridge from FIG. 1.
Figure 4:
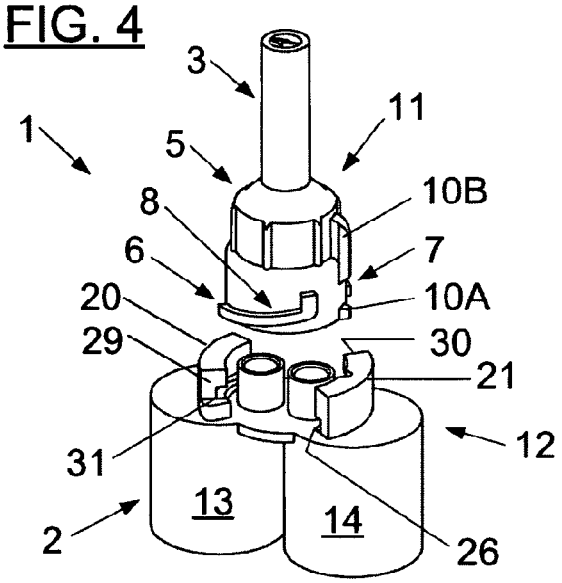
FIG. 4 shows a perspective view of the mixer from FIG. 1 before it is fitted onto the cartridge from FIG. 1.

In cartridges with a container ratio of 1:1, the two gaps or circumferential sections can be identical, but in the case of ratios from 2:1 to 10:1 it is necessary for the mixer to be fitted in a unique orientation, such that, for coding purposes, the two values for A and B are different, as is shown in FIGS. 2 and 3.

In the inner wall 22, 23 of the socket jaws 20, 21, a guide groove 25, 26 is respectively provided which extends at an incline about the circumference and whose incline and shape correspond substantially to the ramps on the accessory part. At the respective entrance opening 27, a shoulder is formed on the socket jaw 20, 21, which shoulder is made up of a plugging guide surface 29, 30 and a plug abutment 31, 32 for the engagement webs 6, 7 on the connector part 5.

Figure 5:
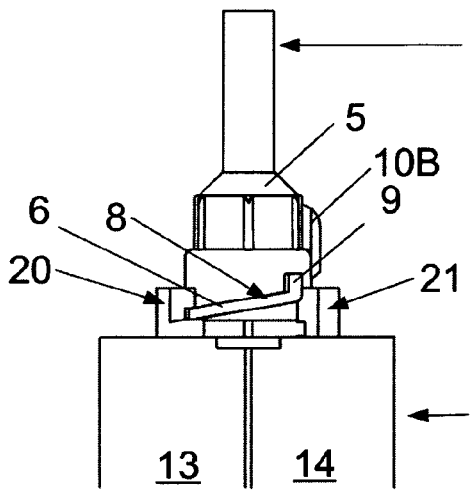
FIG. 5 shows a perspective view of the parts from FIG. 4 plugged into one another, before the mixer is tightened.

FIG. 5 shows the discharge arrangement 1 after the connecting components 12 and 11 on the cartridge 2 and on the accessory part 3, respectively, have been plugged into one another. By means of the shape of the socket jaws 20, 21 being matched to the jacket surface of the connector part 5, and the shape of the gaps A, B to the plugging cross section of the engagement webs 6, 7, a lengthwise axial plugging guide surface is ensured for plugging in the connecting component 11.

Moreover, the arrangement of the respective plug abutment 31, 32 ensures that, after assembly, the respective free end of the ramp 8 is located in the front area of the entrance opening 27. The plug abutment 31, 32 is chosen such that the rear face of the connector part 5 is at a distance from the outlet flange 17. When the connecting components 12 and 11 are plugged together, the plug abutment 31, 32 ensures for the user that the engagement webs 6, 7 are positioned in the intended rotation position.

Figure 6:
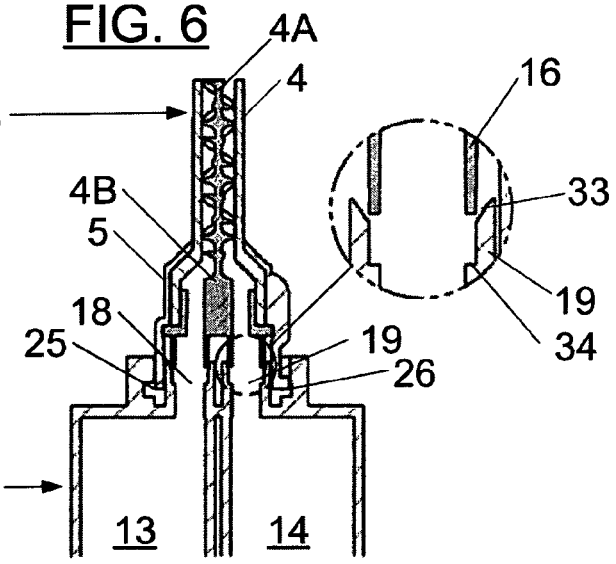
FIG. 6 shows a longitudinal section of the view from FIG. 5.
Figure 6:
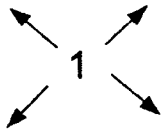
Figure 8:
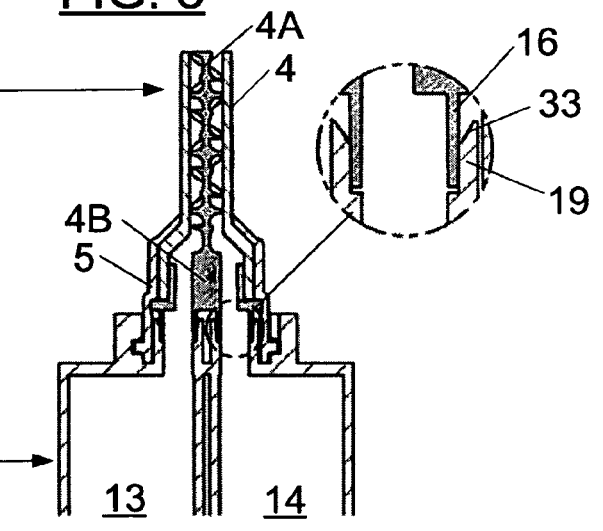
FIG. 8 shows a longitudinal section of the view from FIG. 7.

The longitudinal sections in FIGS. 6 and 8 show, in addition to the mutual engagement of the engagement parts, the sliding of the inlets and outlets into each other, wherein the inner edge of the outlets 18, 19 is designed as insert cone 33.

Figure 7:
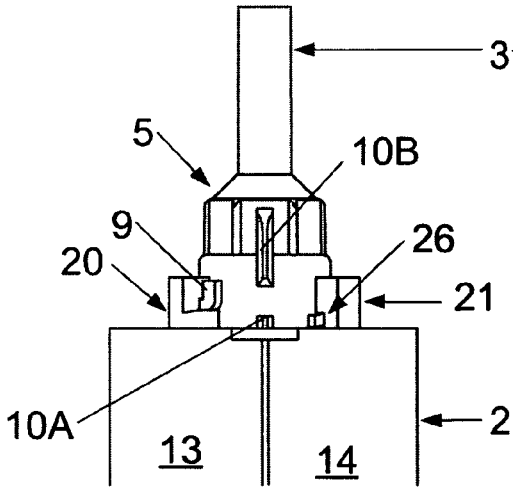
FIG. 7 shows a perspective view of the parts from FIG. 5 plugged into one another, after a rotation through 90°.

FIG. 7 shows the discharge arrangement after the connecting components 11 and 12 have been plugged into each other and after the engagement parts 6, 7 and 25, 26 provided thereon have been fully rotated into each other. The incline of the rotational guide ensures that the rear face of the connector part is now guided completely onto the outlet flange and the inlets and outlets are plugged together. After the engagement parts 6, 7 and 25, 26 have been fully rotated into each other with a form fit, the rotation abutment 9 on the engagement webs 6, 7 effectively avoids undesired further turning of these engagement parts.

The engagement parts 6, 7 each preferably extend along only a partial circumference of the connector part 5 or of the socket formed by the socket jaws 20, 21, such that only a partial revolution is needed to fully establish the connection and, therefore, only a simple maneuver is required on the part of the user. A position of complete engagement of the engagement parts is advantageously obtained after substantially one quarter of a revolution. A particularly smooth turning of the engagement parts can further be achieved by the fact that the rotational guide is not too steep and is arranged, with respect to the longitudinal axis circumference, at an angle of inclination of at least 4° and at most 20°, preferably at least 7° and at most 16°.

Since the ramp 8 and the guide groove 25, 26 have substantially a constant width along their entire length, a form fit is established via their width, in each phase of rotation, along their increasingly mutually engaging longitudinal section. Thus, a positional fixing of the connecting components 11, 12 is already ensured during the rotation.

The fact that the two engagement parts 5, 7 and 25, 26, respectively, are arranged opposite each other provides the user with the advantage of a doubly assisted rotational guide in which a stable connection between the connecting components 11, 12 can be produced even along a short rotation distance, and as a result of which it is possible to effectively prevent unwanted jamming or slipping of the connecting components 11, 12 during the rotation.

FIGS. 9 to 12 show a design variant in the form of a discharge arrangement 35 which comprises a cartridge 36 and an accessory part 37, which in this case is likewise a mixer. The structural parts of the discharge arrangement 35 corresponding to the preceding illustrative embodiment are provided with the same reference numbers. In contrast to the details according to FIGS. 1 to 8, the guide grooves in this case are arranged on the connector part 48, which is likewise a union sleeve, and the ramps are arranged on the socket jaws 20A, 21A of the cartridge.

In this variant too, the connecting component on the connector part can be directly on the housing of the accessory part.

The mixer 37 is substantially identical to the above-described mixer 3, but the engagement parts rising from the jacket surface of the connector part 48 are arranged in a U shape and are each designed as a guide groove 40, 41. The two mutually parallel webs 38, 39 of the respective engagement parts extend approximately a quarter of the way around the outer circumference of the connector part 48 and are at an incline. The parallel web arranged farther from the end face of the connecting component 11 is in each case adapted in length to the spacing of the socket jaws 20A, 21A and can be inserted into the respective gap A, B. The parallel web 38 arranged at the outlet side protrudes past the other parallel web 39 and its end part forms a plug abutment 42A and 42B. The middle branch arranged in each case at the end between the parallel webs 38, 39 performs the function of a rotation abutment 43.

The cartridge 36 has two containers 44 and 45 with different diameters. In the socket jaws 20A, 21A, respective ramps 46, 47 are formed whose shape and thickness Y', Z' are in each case complementary to the shape and width Y, Z of the guide groove 40, 41 of the connector parts.

In principle, the guide grooves 40, 41 and also the ramps 46, 47 can each have the same width or thickness, such that the mixer can be mounted and connected in two positions differing by 180°. This configuration is generally used in cartridges with a container ratio of 1:1.

Figure 9:
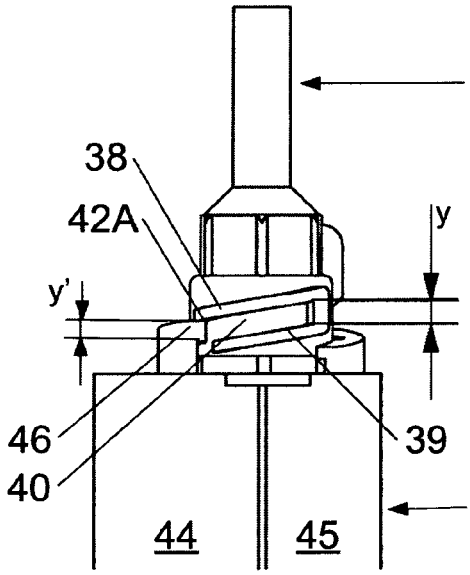
FIGS. 9 to 12 show an alternative embodiment to the embodiment according to FIGS. 1 to 8.
Figure 10:
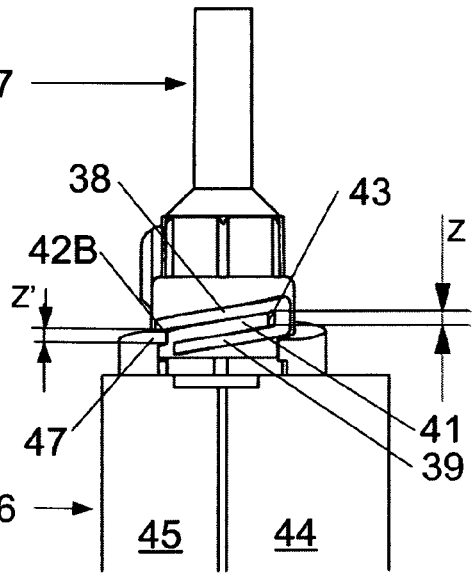
Figure 10:
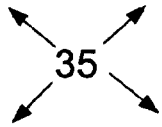

A comparison of FIGS. 9 and 10, which show the cartridge 36 with attached mixer 37 from two sides, reveals that for coding purposes the guide groove 40 of the U-shaped connector part 38 of the mixer has a greater width Y than the width Z of the other guide groove 41. The complementary ramps 46, 47 on the cartridge have a corresponding different thickness Y' and Z'. This ensures that the mixer can be plugged in and connected in only one position.

For effective coding, the inlet-side end of the union sleeve 5 has a coding lug 10A, which fits into a coding indent 24 in a socket jaw 21 (see FIGS. 2 and 3). In some circumstances it may be difficult to correctly fit the mixer in the case of a different web width, such that visual coding means are helpful. For this purpose, the union sleeve has a visual coding 10B at the level of the coding lug.

Analogously to the first illustrative embodiment, the union sleeve 48 of the second illustrative embodiment has a coding lug 49A and visual coding means 49B.

FIGS. 9 and 10 show the discharge arrangement 35 after the connecting components 11 and 12 have been plugged into each other, wherein contact of the respective plug abutment 42 against the end wall of the socket jaws 20A, 21A ensures a positioning of the ramps 46, 47 in front of the entrance area into the guide grooves 40. The end wall is likewise designed here as an inclined plane.

Figure 11:
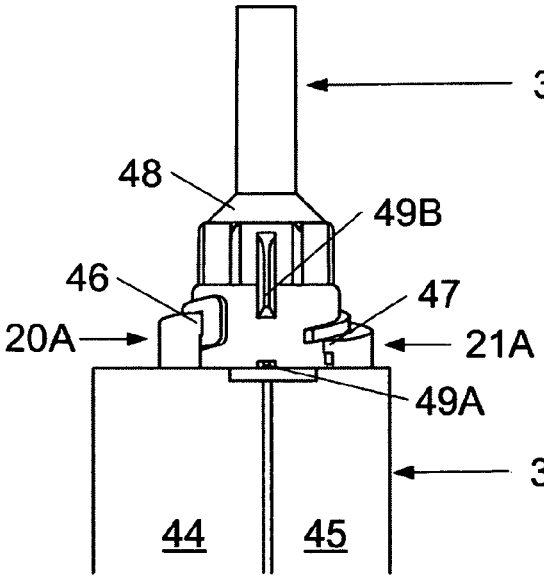
Figure 12:
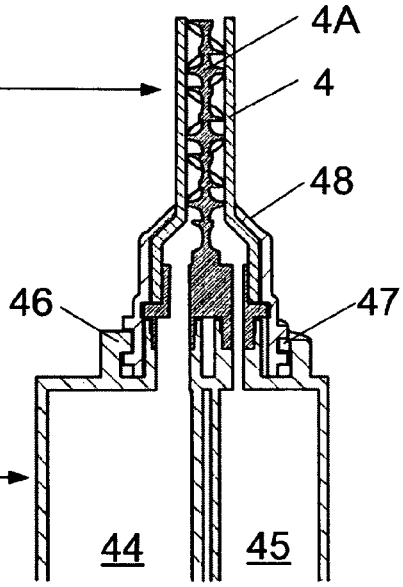

FIGS. 11 and 12 show the discharge arrangement 35 after the connecting components 11 and 12 have been plugged into each other and the engagement parts provided thereon have been fully rotated into each other about a quarter of a revolution as far as the rotation stop provided by the respective rotation abutment 43.

The coding provided by different thickness of the ramps on both sides of the cartridge in the second illustrative embodiment can analogously be transferred to the first illustrative embodiment with a different thickness of the engagement parts on both sides of the connector part.

If cartridges with storage containers and outlets having different diameters and therefore different mixing ratios are used, there is the danger that, if the mixer input part has correspondingly different inlets, the greater component suppresses the lesser component. According to EP 0 885 651 B1, it is then advantageous to design the mixer input area in such a way that this lesser component is not suppressed and, therefore, proportional mixing can be achieved right at the start of the dispensing procedure.

Figure 13:
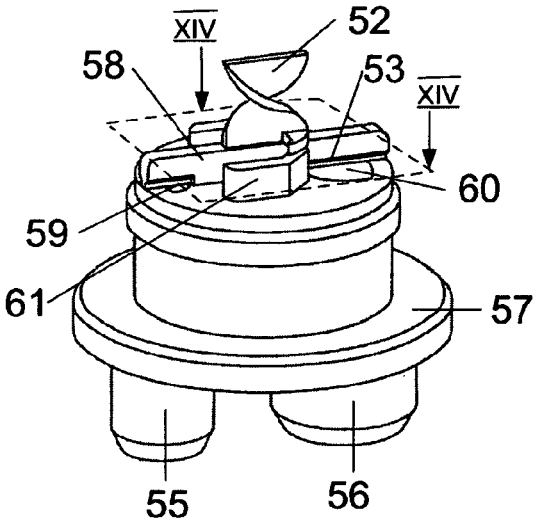
FIG. 13 shows a perspective view of a variant of a mixer input part.
Figure 14:
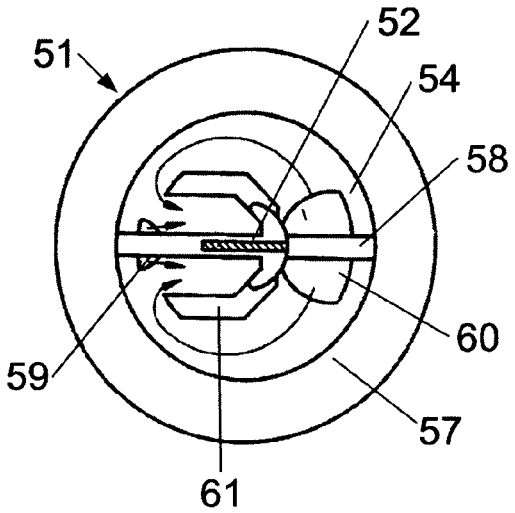
FIG. 14 shows a plan view of the mixer input part from FIG. 13.
Figure 14:
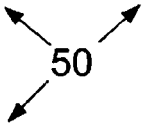
Figure 15:
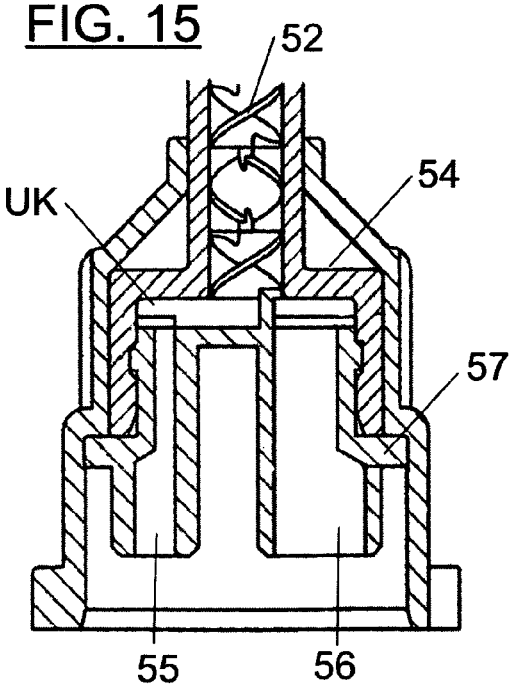
FIG. 15 shows a longitudinal section through the mixer input part from FIG. 13.

FIGS. 13 to 15 show a suitable mixer input arrangement according to the abovementioned patent. The mixer 50 has an input part 51 which, on the outlet side, has a mixing coil 52 with a separating edge 53 of the first mixing coil, which is arranged on an end-plate 54 and, on the inlet side, the two inlets 55 and 56, which are arranged on a flange 57. Aligned with the separating edge 53 of the first mixing coil is a separating web 58, which is arranged in the center of the two entry openings 59 and 60 (see in particular FIG. 14). A U-shaped deflecting web 61 is arranged between the openings, as a result of which the stream of the greater component is deflected and takes with it the lesser component, before both components reach the separating edge of the first mixing coil (see arrows in FIG. 14). The material stream is forced to flow between the end-plate and the mixer housing along the end-plate, as a result of which a deflecting chamber UK is formed, which right from the start ensures a proportional mixing after the separating edge on the mixer element is reached. The exact structure and the mode of operation of this arrangement is adequately explained in the abovementioned EP 0 885 651 B1.

Figure 16:
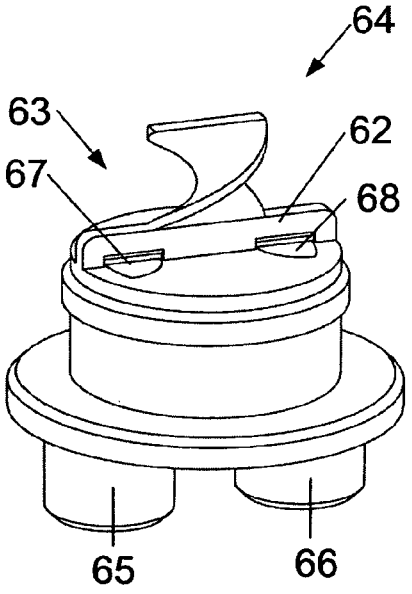
FIG. 16 shows a perspective view of another variant of a mixer input part.

FIG. 16 shows a variant for a 1:1 cartridge with a separating web 62, which is arranged on an input part of a cartridge 64 and aligned with the separating edge of the first mixing coil and ensures that equal substreams of each component flow into the two partial cross sections of the first mixing coil and thus produce an optimal mixing. The cartridge 64 has identical inlets 65, 66 and openings 67, 68. The connecting component 11 for the variants according to FIGS. 13 to 16 is the same as described hereinabove.

The above description reveals the following points among others:

The connecting components not only permit rapid and leaktight attachment of a mixer to a cartridge without excessive force being applied, but especially also a lifting and separation of the inlets and outlets, which can otherwise be a problem given the conicity of the inlets and outlets and the incipient hardening of the components, and subsequently a removal and exchange of mixers.

In addition to the described and in each case dual arrangement of engagement parts lying opposite each other or counter to each other, the connecting components can also have a different arrangement and different number of engagement parts.

In addition to the illustrated design of the engagement parts as ramps and guide grooves, engagement parts of other shapes are also conceivable which are designed corresponding to each other and which can be brought increasingly into engagement with each other during the rotation and are easily releasable.

As has been described, mutually complementary engagement parts are provided in the socket and on the connector part, which engagement parts can be brought increasingly into engagement with each other during rotation, in order to effectively produce the connection, and provide a rotational guide which extends along a circumference about the longitudinal axis and has a guide component in the direction of the longitudinal axis. This inclined position of the rotational guide ensures, during production of the connection, a constrained guiding of the accessory part onto the cartridge and, during release of the connection, a constrained lifting of the accessory part from the cartridge, but without great force being applied. This constrained lifting of the accessory part from the cartridge is essential to the invention and is likewise permitted via the guide in the effective connecting section.

The circumferential arrangement, according to the invention, of mutually corresponding engagement parts also affords the possibility of creating, by special shaping of the engagement parts, a coding for mutually associated cartridges or syringes and accessory parts. This prevents a situation where two non-corresponding complementary parts can be rotated into each other, for example avoiding undesired assembly of a cartridge and accessory part that do not belong to each other. In the case of a guide groove or ramp, this kind of rotation coding can be realized, for example, by engagement parts not associated with each other having different widths.

Only a selection of coding types are set forth by way of example in the above description, and a large number of other coding possibilities are possible according to EP 1 440 337.

The invention claimed is:

1. A discharge arrangement, comprising:

an accessory part with at least two inlets;

a cartridge for at least two components, wherein the cartridge has at least two chambers for in each case one of the components and has at least two outlets, complementary to the inlets, for the components, wherein each of the outlets is adapted to be plugged into one of the inlets, or vice versa; and a connecting device with a first connecting component, which is arranged on the accessory part, and a second connecting component, which is complementary to the first connecting component and is arranged on the cartridge, wherein one of the connecting components comprises a socket and the other connecting component comprises a connector part that is adapted to be inserted into the socket along a longitudinal direction, wherein first engagement parts of a rotational guide placed at an incline to the longitudinal direction are provided on an outer circumference of the connector part, and corresponding second engagement parts of the rotational guide are provided on the inner circumference of the socket, wherein the connecting components are adapted to be rotated into each other over an effective connecting section along the rotational guide after the connector part has been plugged into the socket, wherein one of the engagement parts comprises guide grooves and the other engagement parts cooperating with the guide grooves comprise at least two ramps, which are designed corresponding to the guide grooves, and wherein the guide grooves and the at least two ramps are adapted to be brought increasingly into engagement with each other while being guided in the axial direction and to be disengaged from each other while being guided over an effective connecting section in the axial direction, such that, when the connection is established, the accessory part is positively guided towards the cartridge in a constrained manner, and such that, when the connection is released, the accessory part is lifted from the cartridge in a positively guided manner to cause a constrained lifting.

2. The discharge arrangement as claimed in claim 1, wherein the guide grooves or the at least two ramps extend only over a partial circumference of the connector part.

3. The discharge arrangement as claimed in claim 1, wherein the guide grooves and the at least two ramps are respectively designed as an elevation on the outer circumference of the connector part or as a depression in the inner circumference of the socket.

4. The discharge arrangement as claimed in claim 1, wherein the socket is designed as at least two socket jaws, which are arranged spaced apart from each other and have a circularly curved inner wall, wherein the guide grooves are formed on the inner wall and form the second engagement parts, and wherein the at least two ramps are formed on the connector part and form the first engagement parts on the connector part.

5. The discharge arrangement as claimed in claim 1, wherein the connector part has at least two guide grooves, which are arranged on the outer circumference and form the first engagement parts, wherein the socket is designed as at least two socket jaws arranged spaced apart from each other, and wherein the at least two ramps are formed on the inner circumference of the socket.

6. The discharge arrangement as claimed in claim 4, wherein each of the guide grooves is formed between a first edge, on the plug-in side with respect to the longitudinal direction, and a second edge extending substantially parallel thereto, wherein the second edge is longer in relation to the first edge, as a result of which an axial plug abutment for a corresponding engagement part is formed.

7. The discharge arrangement as claimed in claim 4, wherein the guide grooves and the at least two ramps cooperating with them are inclined with respect to the longitudinal axis of the discharge arrangement at an angle of inclination of at least 4° and at most 20°.

8. The discharge arrangement as claimed in claim 4, wherein gaps of different length are formed between the socket jaws, and wherein the at least two ramps have different lengths corresponding to the different lengths of the gaps, such that the gaps and the at least two ramps act as coding means, in order to ensure a uniquely oriented fitting of the accessory part onto the cartridge.

9. The discharge arrangement as claimed in claim 1, wherein at least one of the engagement parts has a rotation abutment.

10. The discharge arrangement as claimed in claim 1, wherein the first connecting component, arranged on the accessory part, comprises the connector part, and wherein the second connecting component, arranged on the cartridge, comprises the socket.

11. The discharge arrangement as claimed in claim 10, wherein the connector part is rotatable with respect to the inlets of the accessory part and is axially secured.

12. The discharge arrangement as claimed in claim 1, wherein the connector part is designed as a sleeve.

13. The discharge arrangement as claimed in claim 1, wherein the cartridge and the accessory part have mutually complementary coding means in order to ensure a uniquely oriented fitting of the accessory part onto the cartridge.

14. The discharge arrangement as claimed in claim 1, wherein the accessory part is designed as a mixer, and, for the proportional mixing of two components, the mixer has a mixer inlet area, which is provided with an end-plate and with a U-shaped deflecting web, in order to form a deflecting chamber together with a mixer housing, wherein a first mixing coil with a separating edge is arranged on the end-plate, wherein the deflecting chamber has a separating web, which divides outflow openings connected to the outlets of the cartridge, and wherein the separating web is aligned with the separating edge of the first mixing coil.

15. The discharge arrangement as claimed in claim 1, wherein the accessory part is designed as a mixer, and, for better mixing of two components, the mixer has a mixer inlet area that is provided with an end-plate, in order to form a separating chamber together with the mixer housing, wherein a first mixing coil with a separating edge is arranged on the end-plate wherein the separating chamber has a separating web, which divides the outflow openings, and the separating web is aligned with the separating edge of the first mixing coil.

16. The discharge arrangement as claimed in claim 1, wherein the guide grooves or the at least two ramps extend only over a partial circumference of the socket.

17. The discharge arrangement as claimed in claim 1, wherein the connector part is integrally formed directly on the housing of the accessory part.

* * * * *